United States Patent [19]

LaMont

[11] Patent Number: 4,813,581

[45] Date of Patent: Mar. 21, 1989

[54] UNITARY COLLAPSIBLE COAT HANGER

[76] Inventor: Romanus M. LaMont, Box F3, Wickenburg, Ariz. 85358

[21] Appl. No.: 59,551

[22] Filed: Jun. 8, 1987

Related U.S. Application Data

[63] Continuation-in-part of Ser. No. 856,488, Apr. 28, 1986, Pat. No. 4,673,115.

[51] Int. Cl.[4] ..... A47G 25/40

[52] U.S. Cl. ..... 223/94; 223/95

[58] Field of Search ..... 16/225, 227; 223/89, 223/94, 95

[56] References Cited

U.S. PATENT DOCUMENTS

| | | | |
|---|---|---|---|
| 2,137,700 | 11/1938 | Reehl | 223/94 |
| 2,290,722 | 7/1942 | Weingarten | 223/94 |
| 2,352,264 | 6/1944 | Horton | 223/92 |
| 2,509,754 | 5/1950 | Badalamenti | 223/94 |
| 2,586,913 | 2/1952 | Burns | 223/94 |
| 2,671,938 | 3/1954 | Roberts | 24/241 |
| 2,716,513 | 8/1955 | Braunstein | 223/94 |
| 2,881,965 | 4/1959 | Fetko | 223/94 |
| 2,906,442 | 9/1959 | McNutt | 223/94 |
| 3,151,788 | 10/1964 | Wingate | 223/88 |
| 3,209,966 | 10/1965 | Wach | 223/93 |
| 3,219,241 | 11/1965 | Newton | 223/94 |
| 3,401,855 | 9/1968 | Balzer et al. | 223/94 |
| 3,441,183 | 4/1969 | Chatkis | 223/94 |
| 3,531,028 | 9/1970 | Vazquez | 223/94 |
| 3,966,100 | 6/1976 | Nelson | 223/92 |
| 4,008,835 | 2/1977 | Budzik | 223/85 |
| 4,114,786 | 9/1978 | Wiese | 223/94 |
| 4,117,960 | 10/1978 | Bengsch et al. | 223/94 |
| 4,186,857 | 2/1980 | Helms, Jr. | 223/94 |
| 4,223,817 | 9/1980 | Hezenveld | 223/94 |
| 4,227,632 | 10/1980 | Collis | 223/94 |
| 4,673,115 | 6/1987 | LaMont | 223/94 |

*Primary Examiner*—Andrew M. Falik

*Attorney, Agent, or Firm*—Cahill, Sutton & Thomas

[57] ABSTRACT

A collapsible coat hanger formed of plastic includes a hook supported by a body member having right and left hanger arms attached thereto by hinges. The body includes a stop member and outer stop shoulders. Right and left symmetrical hinged locking arms are connected by hinges to inner surfaces of the left and right hanger arms and are connected together at their upper inner edges by a center hinge. Each locking bar has an upper boss with a perpendicular bearing surface. The ends of a C-shaped integral spring are attached to the left and right locking arms, respectively, by hinges on either side of the center hinge. When the hanger is collapsed, the spring is in its relaxed configuration, and the center hinge is below the spring hinges. When the hanger is in its open configuration, the center hinge is above the spring hinges and engages the stop member. The bearing surfaces engage shoulders of the stop member, locking the hanger in its open configuration.

12 Claims, 3 Drawing Sheets

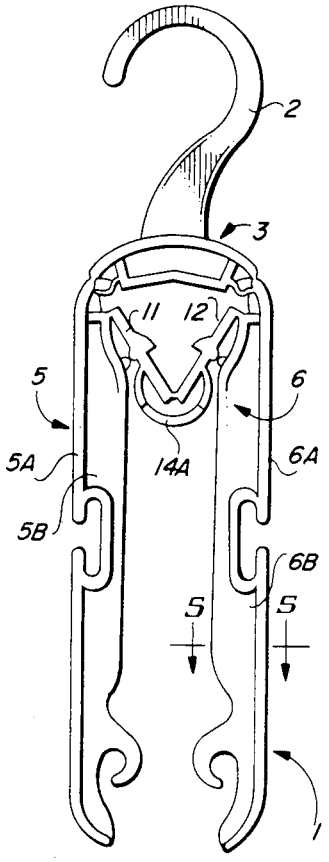
FIG. 1
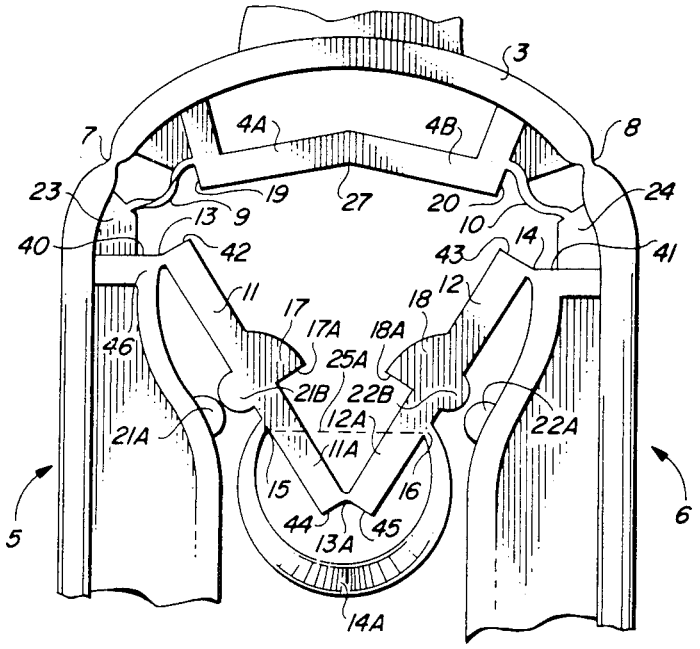
FIG. 3
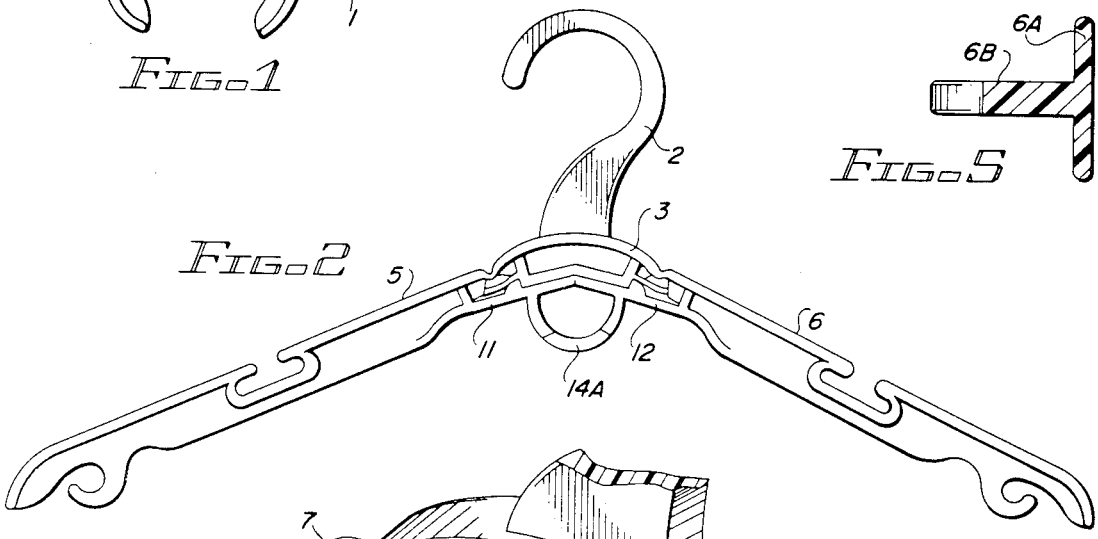
FIG. 2
FIG. 5
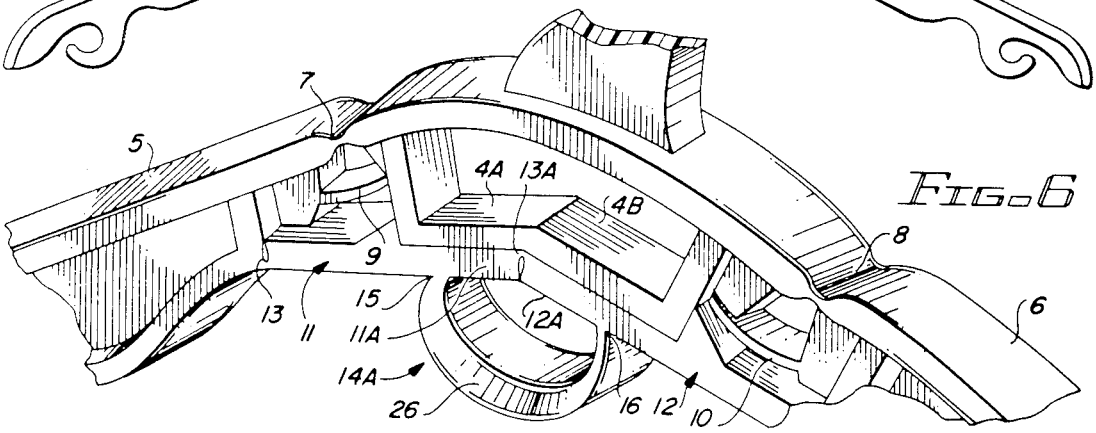
FIG. 6

FIG. 4
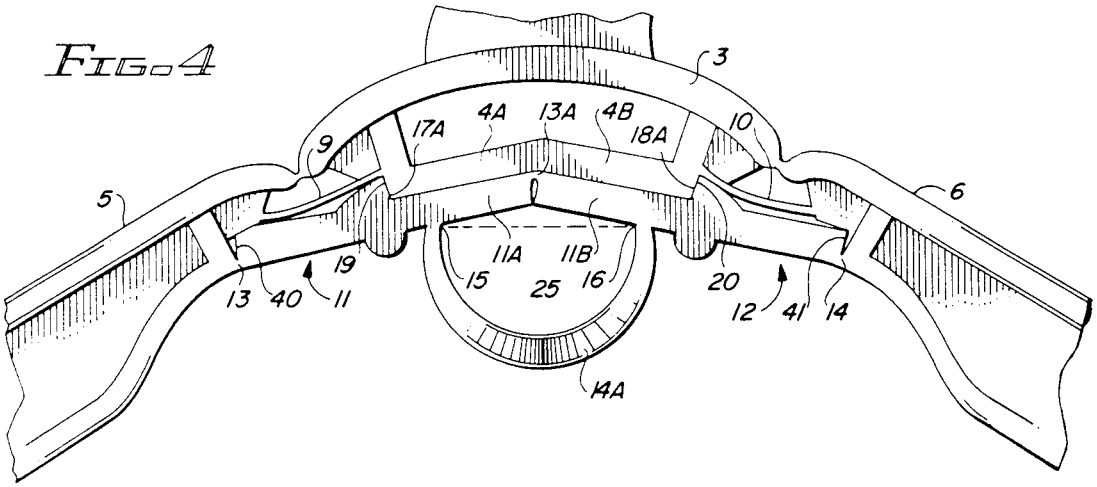
FIG. 7
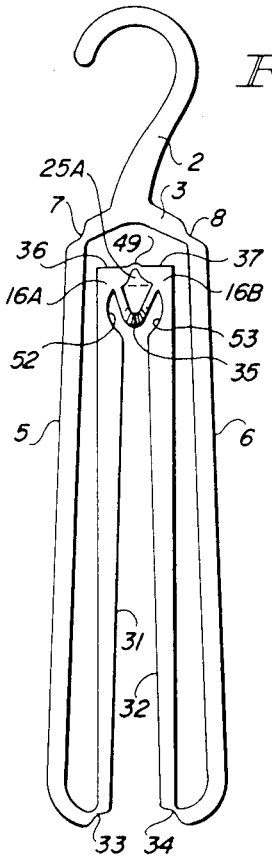
FIG. 9
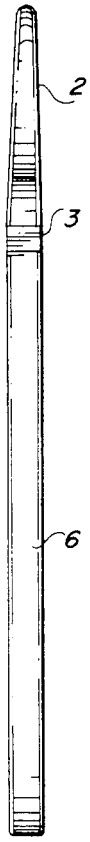
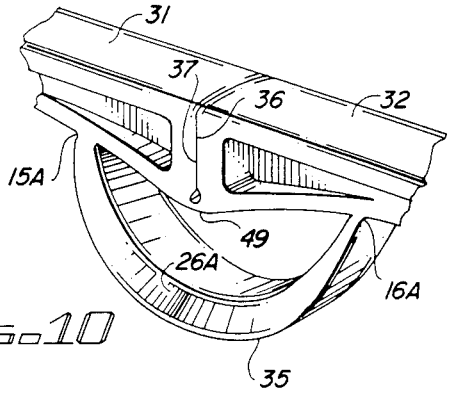
FIG. 10
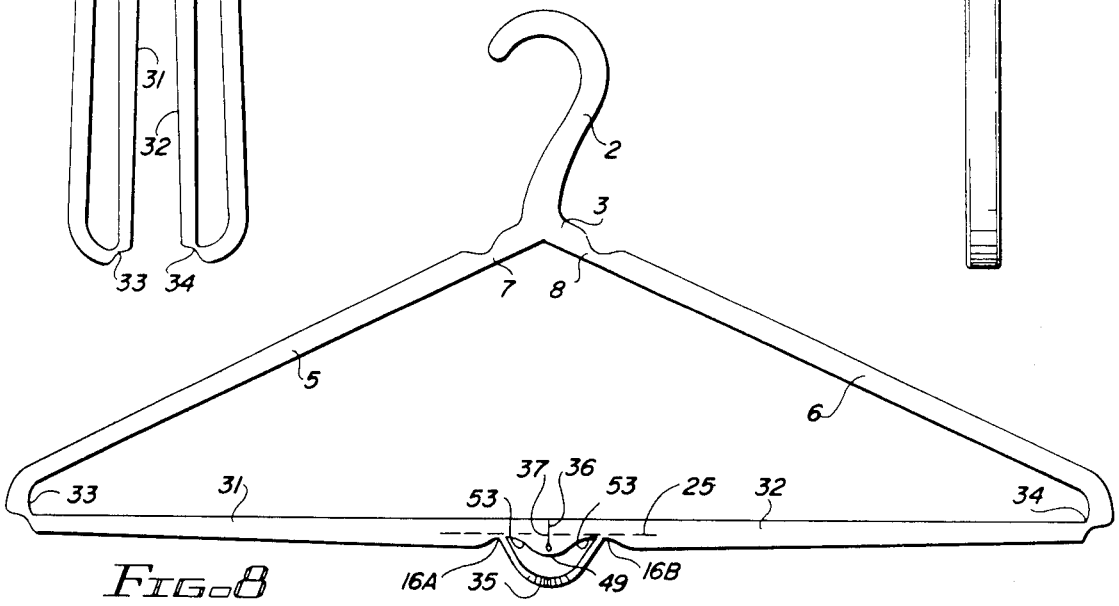
FIG. 8

FIG. 11
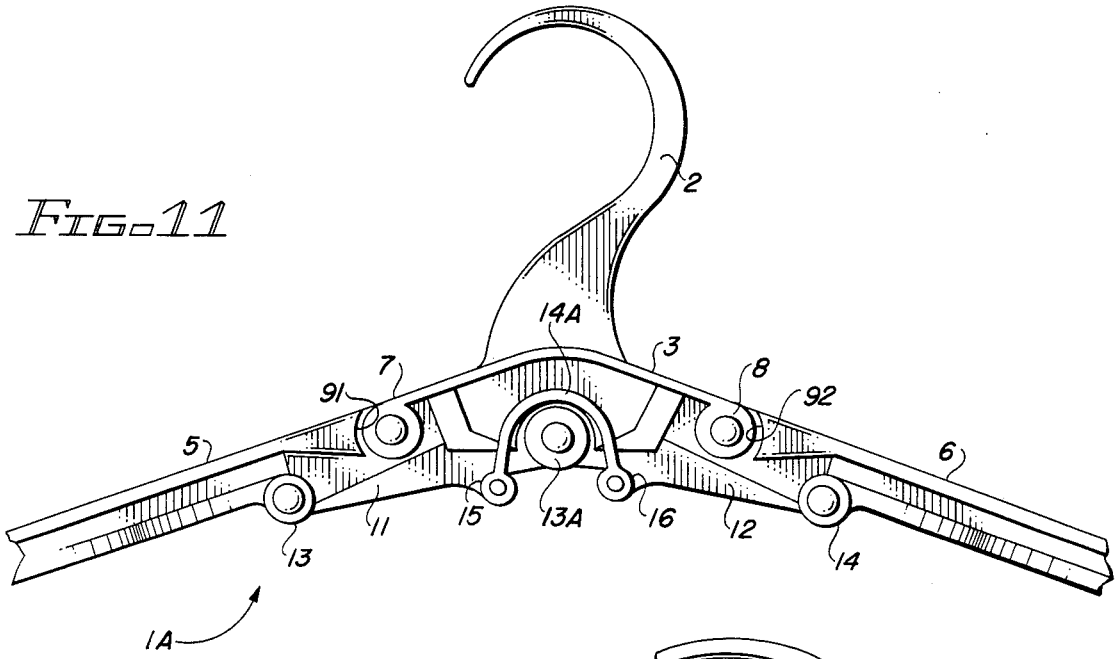
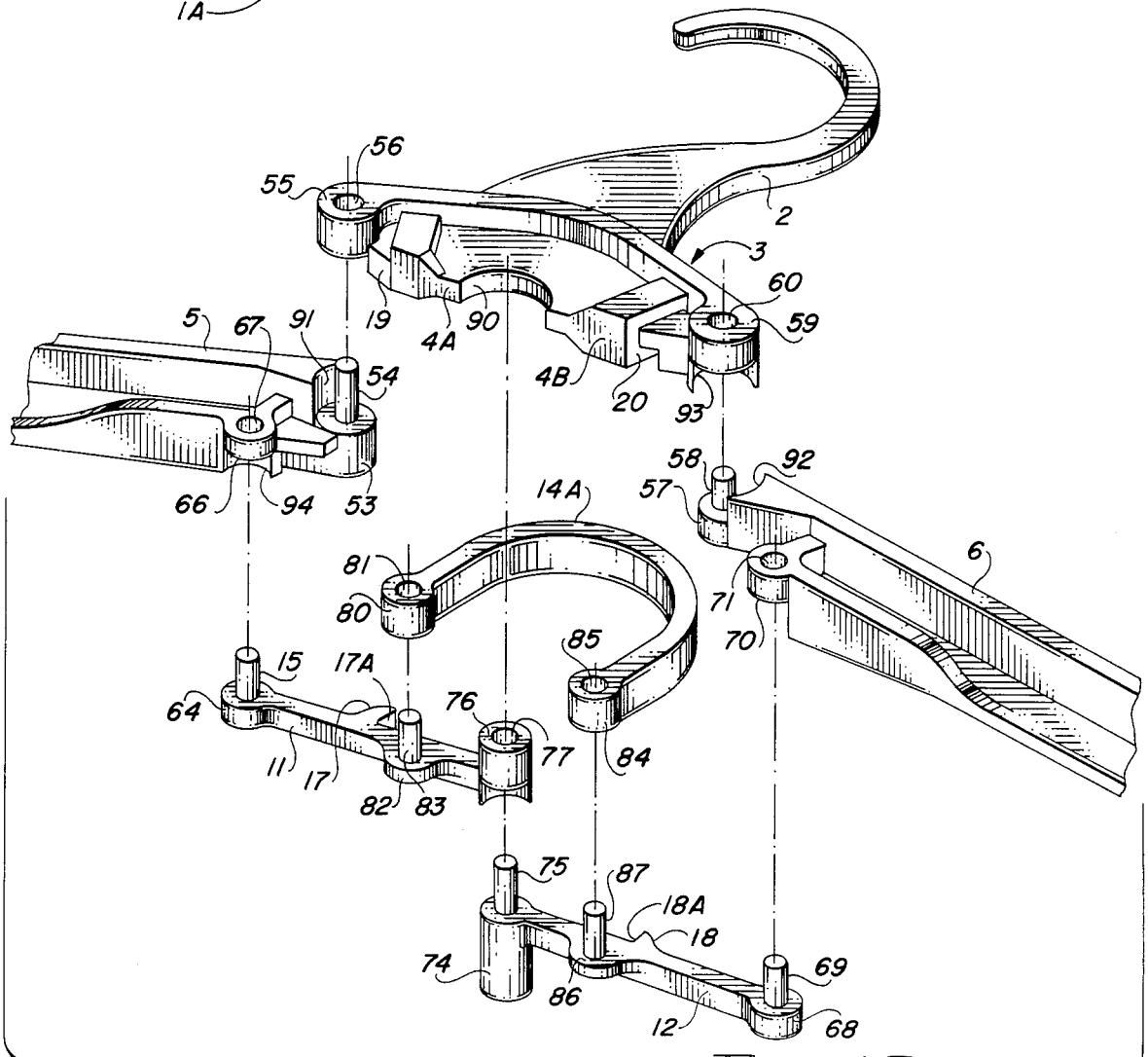
FIG. 12

UNITARY COLLAPSIBLE COAT HANGER

CROSS-REFERENCE TO RELATED APPLICATION

This application is a continuation-in-part of my allowed pending patent application "UNITARY COLLAPSIBLE COAT HANGER", Ser. No. 856,488, filed Apr. 28, 1986, now U.S. Pat. No. 4,673,115, issued June 16, 1987.

BACKGROUND OF THE INVENTION

The invention relates to collapsible coat hangers, and particularly to a hanger with hinged locking arms biased by a C-shaped spring to first and second off-center configurations.

There long has been a need for a collapsible coat hanger that is very inexpensive, yet is of very durable construction, is easily deployed by a user to collapse it into a folded configuration or erect it into an opened garment supporting configuration. Most people experience a need at one time or another for a coat hanger that when collapsed can easily fit in a suitcase without occupying much space, yet will not cause damage to the interior thereof or to clothing packed tightly therein. Such a collapsible coat hanger must easily support the weight of ordinary garments, including heavy coats. For some applications, for example in clothing stores, another desirable feature of a collapsible coat hanger would be that it is easily manipulated to a collapsed configuration to rapidly remove a garment, and can be easily erected or expanded to support a garment with little manipulation of either the coat hanger of the garment.

The state-of-the-art is indicated in U.S. Pat. No. 4,227,632 (Collis), which I regard as the closest prior art, and also is indicated by U.S. Pat. Nos. 4,186,857, 4,223,817, 4,114,786, 4,117,960, 4,008,835, 3,966,100, 3,531,028, 3,441,183, 3,209,966, 3,151,788, 2,906,442, 2,881,965, 2,716,513, 2,671,938, 2,509,754, 2,352,264, and 2,137,700.

Despite the large number of attempts that have been made to provide a commercially practical folding coat hanger, as evidenced by the above prior art, no one has yet provided a device that has been sufficiently satisfactory to enjoy widespread commercial success.

It would be desirable to provide an improved hinge structure for the C-shaped spring described in the above indicated pending patent application Ser. No. 856,488.

SUMMARY OF THE INVENTION

Accordingly, it is an object of the invention to provide a very low cost, simple collapsible coat hanger.

It is another object of the invention to provide an inexpensive collapsible coat hanger that is very easily deployed to erect the hanger from a collapsed state or vice versa.

Briefly described, and in accordance with one embodiment thereof, the invention provides a collapsible coat hanger and a body connected to a hook and connected by hinges to left and right garment supporting arms that hang downward in a collapsed configuration and extend outwardly in an erected or opened configuration by left and right locking arms having inner ends connected by a center hinge and having outer ends connected by hinges to the left and right support arms, center portions of the locking arms being connected by hinges to end portions of a C-shaped spring. In the collapsed configuration of the coat hanger, the locking arms fold toward each other as the C-shaped spring moves to a relaxed configuration. As the support arms are erected, the locking arms pivot upward about their hinged outer ends, and their hinged inner ends move from below to above the left of the hinged ends of the C-shaped spring and engage a stop member. Bosses on the upper surface of each of the locking arms each have a bearing surface that abuts opposed ends of the stop member and effectively resist compression as the let and right support arms are pressed downward by the weight of a garment. The outer ends of the locking arms abut bearing surfaces of the first and second arms, resisting downward movement of the support arms. In the described embodiment of the invention, the coat hanger is composed of polypropylene.

In an alternate unitary embodiment of the invention, left and right garment support arms are connected by hinges to a body connected to the next of a hook. The lower ends of the left and right support arms are hingably connected to integral trouser bars that have inner ends joined at lower edges thereof by a center hinge. Upper edge bearing surfaces adjacent to the center hinge of the rouser bars abut when the coat hanger is erected. A C-shaped spring has its outer ends connected by hinges to the lower surfaces of the left and right trouser bars on either side of the center hinge. In its collapsed configuration, the inner portions of the trouser bars fold upward between the left and right garment support bars as they are folded downward. The center hinge of the trouser bars is located below the hinges of the C-shaped spring when the coat hanger is in its erected configuration, and is above the spring hinges when the hanger is collapsed.

BRIEF DESCRIPTION OF THE DRAWINGS

FIG. 1 is a plan view of a unitary collapsible coat hanger of the present invention shown in its collapsed configuration.

FIG. 2 is a plan view of the coat hanger of FIG. 1 in its erected configuration.

FIG. 3 is an enlarged partial plan view showing the operative locking arm mechanism of the coat hanger of FIG. 1.

FIG. 4 is an enlarged partial plan view showing the operative locking arm mechanism in the erected coat hanger of FIG. 2.

FIG. 5 is a section view taken along section line 5—5 of FIG. 1.

FIG. 6 is a partial perspective view illustrating the integral locking arm mechanism of the coat hanger in its erected configuration.

FIG. 7 is a plan view of an alternate embodiment of the invention in its collapsed configuration.

FIG. 8 is a plan view of the coat hanger of FIG. 7 in its erected configuration.

FIG. 9 is a side view of the coat hanger of FIG. 7 in its collapsed configuration.

FIG. 10 is a perspective view illustrating the integral spring and trouser bar hinging mechanism of the coat hanger of FIG. 8.

FIG. 11 is a partial elevation view of an alternate embodiment of the coat hanger showing the operative locking arm mechanism in its erected configuration.

FIG. 12 is a partial perspective exploded view of the locking arm mechanism of the coat hanger of FIG. 11.

DESCRIPTION OF THE INVENTION

Referring now to FIGS. 1–6, collapsible coat hanger 1 includes a hook 2 attached to a body 3 that includes a frame stop member having a left section 4A with a slightly upwardly sloped bottom surface and a right-hand portion 4B having a slightly upwardly sloped bottom surface. The bottom surface of section 4A and the bottom section of surface 4B join at a peak 27.

The left end of frame stop section 4A includes a flat bearing surface of shoulder 19. (The term "bearing surface" is used herein to describe a surface that bears a compressive force.) The right-hand end of section 4B includes a bearing shoulder 20.

The left end of body 3 is connected by means of an integral hinge strap 7 to a long left garment supporting arm 5. Similarly, a right garment supporting arm 6 is attached to the right end of body 3 by a flexible hinge strap 8.

The outer surface of support arm 5 has a flange 5A about one-half inch wide. A web 5B is attached to flange 5A to provide structural rigidity of support arm 5. Similarly, support arm 6 includes an outer flange 6A attached to a web 6B, as better shown in the cross-section of FIG. 5. If desired, suitable garment strap recesses can be provided in flanges 5A and 6A, as shown in FIG. 1.

In accordance with the present invention, a left locking arm 11 having a perpendicular bearing surface 42 at its left end is connected at its lower left-hand corner by means of a hinge strap 13 to a thickened inner flange 46 attached to web 5B and flange 5. Locking arm 11 includes a right-hand portion 11A having a perpendicular bearing surface 44 at its right end. The upper right-hand corner of section 11A is connected by an integral hinge strap 13 to the upper left-hand corner of section 12A of a right-hand locking arm 12. The right end of locking arm 12 has a perpendicular bearing surface 43. The lower right-hand edge portion of locking arm 12 is connected by an integral hinge strap 14 to a widened flange portion 47 of hanger arm 6 connected to web 6B and flange 6A. The left-hand end of locking arm 12 has a perpendicular bearing surface 45.

In accordance with the present invention, locking arm 11 includes a boss 17 disposed on its upper surface. Boss 17 has a nearly perpendicular bearing surface 17A for abutment against bearing surface 19 of frame stop section 4A when hanger 1 is "open" or in its "erected configuration". Similarly, locking arm 12 has a boss 18 having a left-hand bearing surface 18A that is nearly perpendicular to its upper surface for abutment with bearing surface 20 of right-hand frame stop section 4B when the hanger is in its open configuration.

Further in accordance with the present invention, a C-shaped spring 14A has one end connected to a portion of locking arm section 11A spaced from center hinge 13 by means of an integral hinge strap 15. Similarly, an integral hinge strap 16 connects the other end of C-shaped spring 14A to the lower surface of a point of locking arm section 12A. The center portion of spring 14A is thickest, its end portions tapering to a reduced thickness.

A solid section 23 of left support arm 5 includes a bearing surface 40 for abutment with bearing surface 42 of locking arm 11 when the hanger is in its erected configuration. Similarly, a solid section 24 of right support arm 6 includes a bearing surface 41 for abutment with bearing surface 43 of locking arm when the hanger is in its erected configuration. A pair of integral straps 9 and 10, which are optional, are connected between section 23 and frame stop member 4A, and between solid section 24 and frame stop member 4B, respectively.

A pair of integral bumper stops 21A and 22A protrude from the inner surfaces of arms 5 and 6, respectively. Aligned bumper stops 21B and 22B protrude from the lower surfaces of locking bars 11 and 12, respectively, limiting the extent to which hanger arms 5 and 6 can swing toward each other when the hanger is collapsed.

In the presently preferred embodiment of the invention, the entire hanger 1 is an integral unit composed of polypropylene, and is formed by injection molding.

In the present embodiment of the invention, the height of hook 2 is about three and one-half inches. The thickness of the integral hinge straps 7 and 8 are 18 mils, and the thickness of the hinge straps 13, 13A, and 14 is 15 mils. The thickness of straps 9 and 10 is 15 mils. The lengths of the above hinge straps are about 40 mils, and the widths are about five-eighths of an inch. The width of straps 9 and 10 is about one-eight of an inch. The lengths of locking arms 11 and 12 are 1.48 inches, and their thicknesses are 0.145 inches. The partial circumference of spring 14A is 1.5 inches, its maximum thickness is 0.140 inches, and its thickness tapers to a minimum value of 0.070 inches. The angle between locking arms 11 and 12 is approximately 66 degrees when the coat hanger 1 is in its collapsed position. The angle between locking arms 11 and 12 is approximately 146 degrees when the coat hanger is in its erected configuration.

Hanger 1 is molded in the closed configuration shown in FIG. 1. Therefore, spring 14A is in its relaxed configuration in the closed position.

To open the hanger, the user can simply grasp hook 2 and press upward on the bottom surface of spring 14A, causing the hanger arms 5 and 6 to spread outward.

With the hanger in its open configuration, it can be seen that downward pressure applied to the upper surfaces of arms 5 and 6 by a garment causes compressive forces to be applied to the bearing surfaces 40, 41, 42, 43, 44, 17A, 17B, 19, 20, and 45. Frame stop members 4A and 4B prevent any further upward movement of locking arms 11 and 12. Bearing surfaces 17A and 18A of bosses 17 and 18 engage bearing surface 19 and 20, respectively, and thereby absorb most of the axial forces imparted by arms 5 and 6 to locking arms 11 and 12, respectively to independently resist downward forces on arms 5 and 6. The forces applied by the stressed spring 14A on hinges 15 and 16, with pivot point 13A being above the dotted line 25 extending through hinge straps 15 and 16 maintains hanger 1 securely in its open configuration. Straps 9 and 10, if used, can limit accidental excessive upward movement of arms 5 and 6 relative to body 3, preventing the hanger from accidentally collapsing.

In order to deliberately collapse the hanger 1, the user need simply press downward on the laterally outwardly protruding sloped upper faces 26 of spring member 14A, shown best in FIG. 6, and thereby apply a downward force on spring 14A sufficient to cause center hinge 13A to be pulled below dotted line 25. This can be performed with the garment on the hanger. In any case, as soon as center hinge 13A passes below doted "center line" 25, the garment support arms 5 and 6 collapse, allowing the hanger to be easily withdrawn through the neck opening of the supported garment. Support arms 5 and 6 return to their vertical configuration as shown in FIG. 1, and the force of spring 14A on hinges 15 and 16 maintains this configuration, since the line 25A is located above center hinge 13A, as shown in FIG. 3.

The above-described embodiment of the invention can be very inexpensively manufactured, since it is formed entirely of polypropylene in a single mold. Those skilled in the art know that polypropylene hinges are very durable and have high tensile strength, sufficient to allow support of the heaviest ordinary garments. The hanger, when opened remains open despite normal handling, and when closed, remains closed. This makes it very convenient to store inside a suitcase or other luggage.

In accordance with good plastic engineering practice, various curved "relief cuts" are provided adjacent to the ends of the hinge straps to avoid sharp angles between the hinge straps and the sections connected thereto in order to reduce stresses. The above-described design results in tensile stresses only on hinges 7 and 8, which can be made sufficiently durable to withstand any expected force. The other forces normally applied to the hanger are compressive. Bumper stops 21A, 21B, 22A, and 22B ensure that an upward force applied to the bottom of spring 14A will always result in opening of support arms 5 and 6.

In contrast to the integral polypropylene coat hanger in the above-mentioned Collis reference, opening and closing of the above-described hanger 1 is always smooth, and can be accomplished with a single motion, without any concern by the user for maintaining proper alignment of any of the elements of the hanger, as is required for the Collis device. For example, the width of the hinge straps 13, 13A, and 14 is sufficiently great that locking arms 11 and 12 always remain in axial alignment in the sense that the edges thereof will move in a plane as the hanger opens and closes.

The collapsible hanger of the invention, can, of course, be implemented by using material other than polypropylene, in which case pin-and-loop type hinges, rather than hinge straps, should be used. FIGS. 11 and 12 show a modified embodiment of the collapsible hanger of FIGS. 1–6 wherein the support arms 5 and 6, the body 3, the hook 2, and the locking arms 11 and 12 can be composed of a different material than polypropylene, such as polyester material or any of a number of other common plastic materials.

Note that each of the hinges in FIG. 11 is designated by the same reference numeral that is used to designate a corresponding polypropylene hinge strap in the hanger of FIGS. 1–6. The collapsible coat hanger of FIGS. 11 and 12 is essentially identical in structure and operation to the hanger of FIGS. 1–6 except for the structure of the individual hinges. The exploded perspective view of FIG. 12 illustrates the details of the modified hinges.

Hinge 7 (FIG. 11) includes an integral pin 54 extending upward from a semicylindrical base 53 attached to support arm 5. Pin 54 extends into a bore 56 of a loop 55 that is integral with body 3. A concave surface 91 at the right end of support arm 5 provides a "fender" or shroud spaced slightly from the outer semicylindrical surface of loop 55. The top of pin 54 extends slightly beyond the mouth of bore 56, so that a peripheral flange can be formed thereon by momentary contact with a heating element to retain the pin 54 in loop 55.

Similarly, hinge 8 of modified coat hanger 1A includes an integral pin 58 extending upward from base 57, which is integral with right support arm 6. Pin 58 extends through bore 60 of a semicylindrical loop 59 attached to the right end of body 3. The semicylindrical outer surface of platform 57 rotates within a concave surface or fender 93 attached to the right end of body 3. A similar concave surface, not shown, is provided on the left end of body 3 to serve as a shroud for outer semicylindrical surface of platform 53.

Hinge 13A connecting the inner ends of locking arms 11 and 12 includes a cylindrical base 74 integral with the left end of locking arm 12. Pin 75 extends upward from the upper surface of base 74 through a bore 77 in cylindrical loop 76, which is integral with the right end of locking arm 11. The left end of locking arm 11 includes a pin 15 extending upward from semicylindrical base 64, which is attached to the left end of locking arm 11. Pin 15 extends upward through cylindrical bore 67 in loop 66, which is integral with support arm 5. Base 64 fits in a concave recess 94 of support arm 5.

Loop 77 and base 74 extend outwardly from the sides of locking arms 11 and 12, respectively, so the user can grip them between his thumb and fingers to lower locking arms 11 and 12 and C-shaped spring 14A to collapse the hanger 1A. This may be more convenient than pressing downward on sloped surface 26 of C-shaped spring 14A of FIG. 6 to accomplish the same purpose.

Similarly, hinge 14 includes pin 69 extending upward from base 68 of the right end of locking arm 12. Pin 69 extends upward through cylindrical bore 71 in semicylindrical loop 70, which is attached to the under side of support arm 6, as shown.

Hinge 15, which connects the left end of C-shaped spring 14A to an intermediate point of locking arm 11, includes a pin 83 extending upward from a base 82 through cylindrical bore 81 of loop 80 of the end of spring 14A. Base 82 is attached to an intermediate portion of locking arm 11. Similarly, hinge 16 includes a pin 87 extending from base 86 through bore 85 in the enlarged right end 84 of C-shaped spring 14A. Base 86 is connected to an intermediate portion of locking arm 12.

A semicylindrical recess 90 in the center of the lower portion of body 3 accommodates cylindrical loop 76 when the hanger is in its erected configuration, as shown in FIG. 11.

As indicated above, the frame stop members 4A and 4B, the bosses 17 and 18 and their respectively bearing surfaces 17A and 18A, and bearing surfaces 19 and 20, locking arms 11 and 12, and each of the hinges 7, 8, 13, 14, 15, 16, and 13A perform precisely the same functions as in the collapsible hanger of FIGS. 1–6, and the detailed operation of hanger 1A of FIGS. 11 and 12 is the same as the one of FIGS. 1–6.

As indicated in FIGS. 11 and 12, the position of the C-shaped spring 14A is rotated by 180 degrees from its orientation in FIGS. 1–6, so that it is positioned above, rather than below the locking arms 11 and 12. In this case, a corresponding recess must be provided in body section 13 to accommodate the new position of C-shaped spring 14A.

Referring now to FIGS. 7–10, an alternate embodiment of the invention, also composed entirely of polypropylene elements molded into a unitary device, includes left and right garment supporting arms 5 and 6 connected by hinge straps 7 and 8, as shown in FIGS. 7 and 8. A left trouser bar 31 is connected at its lower end by an integral hinge strap 33. A right trouser bar 32 is connected at its lower end by a hinge strap 34 to the lower end of right garment support arm 6. The upper ends of trouser bars 31 and 32 have cutaway portions 52 and 53, respectively, to receive hinge strap connections to the respective ends of a C-shaped spring 35. More specifically, spring 35 has its left end connected by a hinge strap 16A to cutaway portion 52 of trouser bar 31. A right end of spring 35 is connected by a hinge strap 16B to cutaway portion 53 of right trouser bar 32.

Trouser bar 31 has a force bearing surface 36 at its upper end, and trouser bar 32 has a force bearing surface 37 at its upper end. The upper inner edges of bearing surfaces 36 and 37 are connected together with an integral center hinge strap 49.

Hanger 30 of FIG. 7 is molded in the closed configuration shown, so C-shaped spring is relaxed in that configuration. Therefore, hanger 30 easily returns to and remains in its closed configuration as shown in order to allow spring 35 to relax.

To open hanger 30, a user simply presses downward on one or both of the flared out surfaces 26A (FIG. 10) of spring 35. This causes trouser bars 31 and 32 to swing outward. When the upper surfaces of trouser bars 31 and 32 are in a straight line, as shown in FIG. 8, bearing surfaces 36 and 37 abut, preventing further downward movement. At this point, the elevation of center hinge 49 is below dotted "center" line 25, which passes through hinge points 16A and 16B in cutaway regions 52 and 53, respectively. Therefore, the inward force produced on hinge straps 16A and 16B by spring 35, which has been expanded as trouser bars 31 and 32 are lowered, maintains hanger 30 in the open configuration. If desired, a thin vertical plate 49A can be attached to the inner end of trouser bar 32, as shown. Plate 49A slides into a mating recess in the back side of trouser bar 31. Plate 49A has a detent 49B at its outer end, which slides into a detent recess (not shown) in the back side of trouser bar 31 as hanger 30 is "opened". This arrangement locks the hanger 30 into its open configuration and prevents too small of an upward force on the bottom of spring 35 from causing hanger 30 to collapse.

To cause hanger 30 to collapse, the user simply presses on the bottom of spring 35 until center hinge 49 moves above center line 25, at which point the hanger collapses and returns to the closed configuration shown in FIG. 7.

Of course, the collapsible hanger shown in FIGS. 7–10 can be implemented by using the pin-and-loop type hinges shown in FIGS. 11–13 instead of integral hinge straps. Also, the orientation of the C-shaped spring 35 in FIGS. 7–10 can be reversed in the manner shown in FIG. 13.

While the invention has been described with reference to a several embodiments thereof, those skilled in the art will be able to make various modifications to the described embodiment of the invention without departing from the true spirit and scope thereof. It is intended that all elements and steps which perform substantially the same function in substantially the same manner to achieve the same result are within the scope of the invention. For example, a simple locking ring can be provided on the hooks 2 to prevent removal from clothes hanger bars in hotels and the like. The width and the height of the body 3 can be increased to extend it through the neck holes of certain garments, if desired, to allow them to be easily centered on the hanger.

I claim:

1. A hanger having an opened or erected configuration for supporting garments and a collapsed configuration, the hanger comprising in combination:

(a) a hook;

(b) a body attached to the hook;

(c) left and right support arms each having an outer surface for supporting a garment and an inner surface, and a first hinge, connecting a left edge of the body to an inner end of the left support arm, and a second hinge connecting a right edge of the body to an inner end of the right support arm;

(d) left and right locking arms each having an inner end connected by means of a third hinge to the inner end of the other, an outer end of the left locking arm being connected by a fourth hinge to the inner surface of the left support arm, an outer end of the right locking arm being connected by a fifth hinge to the inner surface of the right support arm;

(e) a C-shaped spring that has a left end connected by a sixth hinge to an intermediate portion of the left support arm and a right end connected by means of a seventh hinge to an intermediate portion of the right locking arm; and (f) frame stop means attached to the body for limiting upward pivoting of the left and right locking arms as the left and right support arms extend outward.

2. The hanger of claim 1 wherein each of the first through sixth hinges includes a loop having an elongated bore therein and an elongated cylindrical pin extending entirely through the bore.

3. The hanger of claim 2 wherein all of the elements are integral and are formed of plastic.

4. The hanger of claim 3 including a left boss extending from an upper surface of the left locking arm and having a first force bearing surface thereon, the right locking arm having a right boss extending from an upper surface of the right locking arm and having a second force bearing surface thereon, the stop member having third and fourth force bearing surfaces thereon, for abutment with the first and second force bearing surfaces when the hanger is in its opened configuration.

5. The hanger of claim 4, wherein the left end of the left locking arm has a fifth force bearing surface thereon and the right end of the right locking member has a sixth force bearing surface thereon, and the left support arm has a seventh force bearing surface thereon for abutment with the fifth force bearing surface when the hanger is in its open configuration and the inner surface of the right support arm has an eighth force bearing surface thereon for abutment with the sixth force bearing surface when the hanger is in its open configuration.

6. The hanger of claim 5 wherein the C-shaped spring member is in its relaxed configuration when the hanger is in its closed configuration.

7. The hanger of claim 6 wherein the frame stop means includes first and second gently sloping lower surfaces that abut adjacent inner upper and surface portions of the left and right locking arms, respectively when the hanger is in its open configuration, the first and second gently sloping surfaces meeting at a raised peak, the third hinge being adjacent to the peak when the coat hanger is in its open configuration, the position of the third hinge being above a center line passing through the sixth and seventh hinges when the hanger is in its opened configuration, the third hinge being below the outer line when the hanger is in its closed configuration.

8. The hanger of claim 7 wherein the thickness of the C-shaped spring member is greatest at its center portions and tapers gradually to a thinnest value at left and right ends, and wherein an angle between left and right locking arms is substantially less when the hanger is in its collapsed configuration than when it is in its open configuration, so that the C-shaped spring member is substantially stressed when the hanger is in its opened configuration and thereby urges the left and right locking arms against the frame stop means, and also urges the hanger to remain in its collapsed configuration.

9. The hanger of claim 8 wherein the left and right support arms, the left and right locking arms the C-shaped spring, and the frame stop means are symmetrically disposed about the third hinge.

10. The hanger of claim 1 wherein the angle between the left and right locking arms is approximately 146° when the hanger is in its open configuration and is about 66° when the hanger is in its collapsed configuration.

11. A hanger having an opened or erected configuration for supporting garments and a collapsed configuration, the hanger comprising in combination:

(a) a hook;

(b) a body attached to the hook;

(c) left and right support arms each having an outer surface for supporting a garment and an inner surface, and a first hinge connecting a left edge of the body to an inner end of the left support arm, and a second hinge connecting a right edge of the body to an inner end of the right support arm;

(d) left and right trouser bars each having an inner end connected by means of a third hinge to the inner end of the other, an outer end of the left trouser bar being connected by a fourth hinge to the inner surface of the left support arm, an outer end of the right trouser bar being connected by a fifth hinge to the inner surface of the right support arm;

(e) a C-shaped spring that has a left end connected by a sixth hinge to a fixed point of the left trouser bar and a right end connected by means of a seventh hinge to a second point of the right trouser bar; and (f) a first force bearing surface on the right end of the left trouser bar and a second force bearing surface on the left end of the right trouser bar, the first and second force bearing surfaces abutting to limit downward pivoting of the first and second trouser bars when the hanger is in its erected configuration.

12. The hanger of claim 11 including a first cutaway portion in the bottom surface of the left trouser bar a predetermined distance from the third hinge and a second cutaway portion of the lower surface of the right trouser bar the predetermined distance from the third hinge, the sixth and seventh hinge connecting the C-shaped spring to the left and right trouser bars in the cutaway portions, a center line passing through the sixth and seventh hinge, the third hinge being located below the center line when the hanger is in its erected configuration and above the center line when the hanger is in its collapsed configuration.

* * * * *